United States Patent [19]

Bossow

[11] Patent Number: 4,968,101

[45] Date of Patent: Nov. 6, 1990

[54] VERTICAL ASPHALT AND CONCRETE MILLER

[76] Inventor: Emory R. Bossow, 7930 S.R. 305, Garrettsville, Ohio 44231

[21] Appl. No.: 426,459

[22] Filed: Oct. 20, 1989

Related U.S. Application Data

[63] Continuation-in-part of Ser. No. 70,042, Jul. 6, 1987, abandoned.

[51] Int. Cl.[5] ..... E21B 10/48; E01C 23/00

[52] U.S. Cl. ..... 299/41; 175/403; 299/90; 404/90; 408/204

[58] Field of Search ..... 299/39, 41, 90; 175/403; 404/25, 26, 90, 91; 125/20; 408/203.5, 204, 205, 206

[56] References Cited

U.S. PATENT DOCUMENTS

| | | | |
|---|---|---|---|
| 799,880 | 9/1905 | Tonge, Jr. | 175/403 X |
| 2,088,141 | 7/1937 | Royston | 172/49.5 |
| 3,097,466 | 7/1963 | King | 172/111 X |
| 3,217,620 | 11/1965 | Mindrum et al. | 404/133 X |
| 3,243,924 | 4/1966 | Peters | 175/403 X |
| 3,472,555 | 10/1969 | Theermann | 299/41 |
| 3,649,071 | 3/1972 | Graff | 404/90 X |
| 3,848,687 | 11/1974 | Funakubu | 175/403 X |
| 3,917,426 | 11/1975 | Wohlwend | 404/133 |
| 4,173,836 | 11/1979 | Paurat | 37/81 |
| 4,262,966 | 4/1981 | Bouplon | 299/39 |
| 4,287,955 | 9/1981 | Anderson | 172/98 |
| 4,332,299 | 6/1982 | Parks et al. | 172/111 X |
| 4,458,949 | 7/1984 | Jury | 299/41 |
| 4,668,017 | 5/1987 | Peterson et al. | 299/89 X |
| 4,761,038 | 8/1988 | Hackmack | 299/10 |

FOREIGN PATENT DOCUMENTS

| | | | |
|---|---|---|---|
| 2242881 | 3/1974 | Fed. Rep. of Germany | 404/90 |
| 221777 | 5/1985 | Fed. Rep. of Germany | 404/90 |
| 348382 | 10/1960 | Switzerland | 299/89 |

*Primary Examiner*—Ramon S. Britts
*Assistant Examiner*—David J. Bagnell
*Attorney, Agent, or Firm*—Michael H. Minns

[57] ABSTRACT

A device for cutting and excavating soils, concrete, asphalt and road surfaces and subsurfaces. The Vertical Asphalt & Concrete Miller is mounted on various types of construction equipment such as a back hoe. The construction equipment normally provides hydraulic fluid to drive the rotary cutting head. Several configurations of replaceable cutting bits are used depending upon the material to be cut. One specific cutting head is a coring bit used to cut the concrete or asphalt around manhole castings, water valves and monument boxes.

22 Claims, 4 Drawing Sheets

VERTICAL ASPHALT AND CONCRETE MILLER

This application is a continuation-in-part of application Ser. No., 07/070,042, filed Jul. 6, 1987, now abandoned.

FIELD OF INVENTION

This invention relates primarily to road construction machinery and, more particularly, to an adaptably mounted rotary cutting head in which interchangeable cutting heads are used.

BACKGROUND OF THE INVENTION

Generally, repair of potholes is done by using jack hammers to loosen the damaged road surface allowing the loose material to be removed. Typically, a shallow saucer-like depression with fractured asphalt around the edges remains. This depression is then filled with fresh asphalt and tamped in place. Whenever a vehicle travels across the repair, it further compresses the patch which results in the outer edges pressing against any unremoved fractured asphalt. This pressure causes the surrounding road surface to further fragment and the saucer-like shape of the repair causes the patch to pop-up out of the hole. Thus, with time, a typical pothole repair fails requiring further repair.

During resurfacing of road surfaces, additional asphalt or concrete is applied to the existing surface so that the new road surface is two to three inches higher than the pre-existing surface. If the road has been resurfaced several times, the road surface is scraped and removed and then a fresh application of asphalt or concrete is made. In either case, where the roadway contains manholes, it is necessary to remove the manhole castings to adjust the height of the manhole castings to the new surface of the roadway.

The Vertical Asphalt & Concrete Miller provides a means of rapidly removing all of the fractured road surface and cutting a deeper straight sided hole. When a vehicle travels across the patch placed into this deeper straight sided hole, the compression of the asphalt pushes into the vertical sides thus causing the patch to remain in place rather than popping out.

The Vertical Asphalt & Concrete Miller is mounted on construction equipment such as a back hoe in place of the normal bucket. This permits the construction equipment to be used for multiple tasks. For example, if a coring bit is attached to the Vertical Asphalt and Concrete Miller, it can be used to remove manhole castings. Prior to this, there have been various dedicated use machines such as trench excavators and manhole casting removing devices.

SUMMARY OF THE INVENTION

It is an object of the invention to provide a multipurpose rotary cutting machine that is adaptably mounted to common construction equipment such as a back hoe.

The Vertical Asphalt & Concrete Miller is a hydraulically driven rotary cutting device. Hydraulic power to the rotary cutting head is supplied by the construction equipment. The cutting head is removable allowing various configurations of cutters to be used for purposes such as concrete milling, road surface planing, post hole digging, cutting tree stump roots and pothole repair. Commercially available quick disconnect hydraulic fittings are used to facilitate mounting and removing the device from the construction equipment.

A second embodiment of the Vertical Asphalt & Concrete Miller uses a coring bit to cut the concrete or asphalt around manhole castings. After the concrete or asphalt has been cut, the manhole casting can be removed from the road. Various size coring bits can be used to allow removal of manhole castings, water valves and monument boxes. A typical manhole casting in 8 inches of concrete can be cut out and removed using a 48 inch diameter coring bit in under ten minutes. The current method for removing manhole castings uses two to three men with jack hammers and associated air compressors and requires 1½ to 3½ hours.

DETAILED DESCRIPTION OF THE INVENTION

Figure 1A:
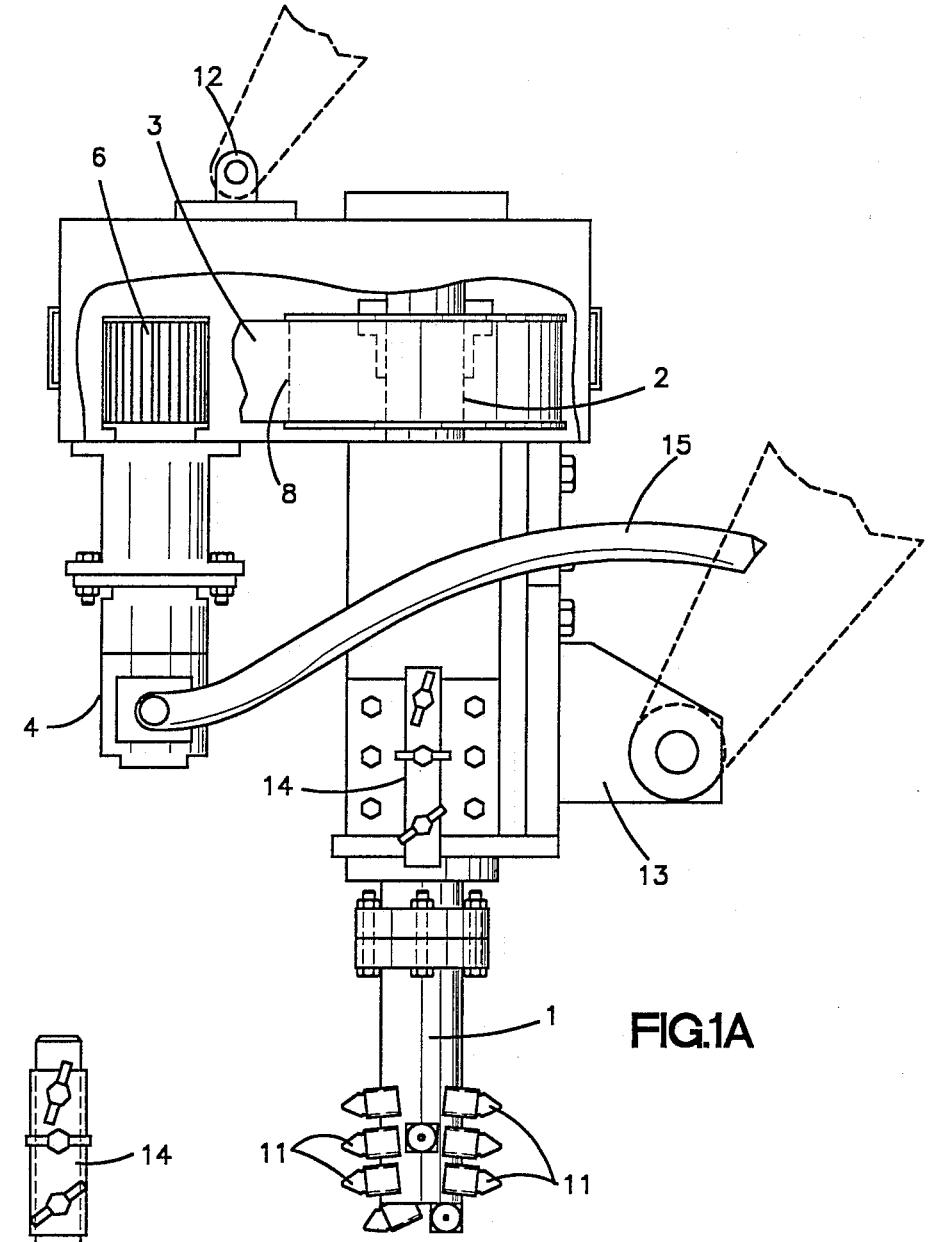
FIG. 1A is a side elevation view of the current embodiment of the Vertical Asphalt & Concrete Miller, illustrating the attachment to the construction equipment and showing the asphalt removal cutting head.
Figure 1B:
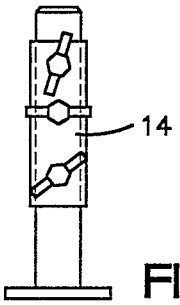
FIG. 1B shows the detail of the depth gages.

The machine illustrated in FIG. 1A is used to mill asphalt and concrete primarily for road surface repairs.

The major components of the Vertical Asphalt & Concrete Miller are a removable cutting head 1 which is connected to a reversible hydraulic motor 4 by a drive shaft 2 and a drive belt 3.

The machine is attached to various pieces of standard construction equipment utilizing adapter plates, 12 and 13. The adapter plates are sized and shaped for the specific equipment to be used. The ones illustrated here are for mounting the Vertical Asphalt & Concrete Miller to a back hoe.

Hydraulic fluid to drive the hydraulic motor 4 is supplied by the construction equipment by two hydraulic lines 15. These hydraulic lines are equipped with quick disconnect fittings (not shown) to facilitate mounting and removing the machine.

The motive force is transmitted from the hydraulic motor 4 to the rotary cutting head 1 utilizing a ribbed drive belt 3 driven by a smaller toothed gear 6 mounted on the jack shaft 7 which is attached to the hydraulic motor. The ribbed drive belt drives the rotary cutting head via a larger toothed gear 8 attached to the drive shaft 2.

Both the drive shaft and jack shaft are supported by conventional bearings 9. These bearings are sealed by conventional seals 10.

The rotary cutting head is bolted to the drive shaft to permit the use of various configurations of cutting bits. The cutting bits 11 are typically carbide bits. These cutting bits are replaceable in the event the bit becomes worn or damaged.

Figure 3A:
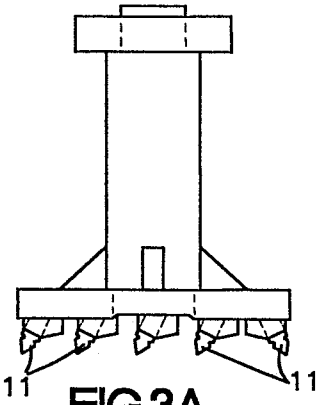
FIGS. 3A and 3B are side elevation and bottom elevation views of the cutting head for planing road surfaces.
Figure 3B:
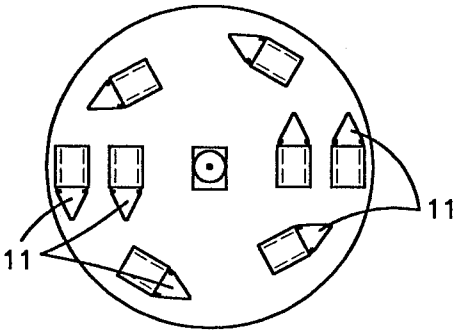
Figure 2:
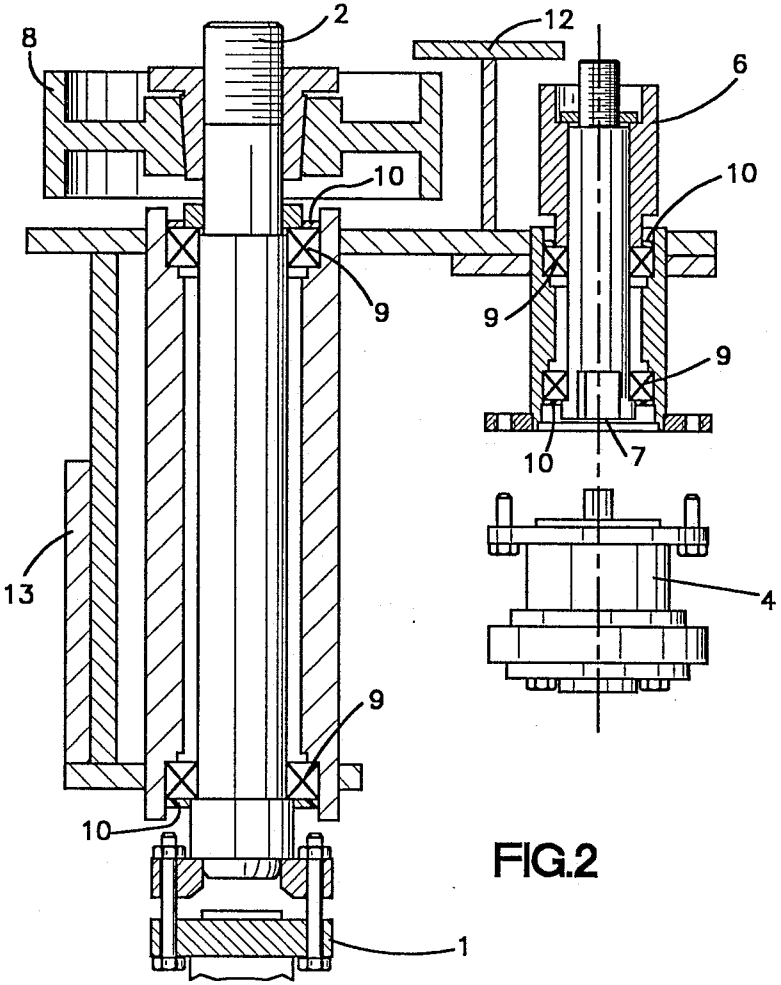
FIG. 2 is a sectional view of the Vertical Asphalt & Concrete Miller.

Various arrangements of cutting bits are used depending upon the material being removed. The configuration shown in FIG. 1A is used primarily for asphalt and sub-surface material removal. FIGS. 3A and 3B show the cutting head for the planing of road surfaces to remove bumps and smooth the road surface. The diameter of the head is larger than that used for concrete removal to permit faster planing of the surface.

Other applications for cutting heads include tree root cutting and post hole digging, especially in soil containing rocks and stones and delagging ladles in steel mills.

Located on both sides of the Vertical Asphalt & Concrete Miller are depth gages 14 which can be used to limit the depth into the surface that the cutting head can penetrate.

The advantages of the Vertical Asphalt & Concrete Miller include the use of adapter plates so that it is adaptable to many different types of construction equipment. By utilizing interchangeable cutter heads, the Vertical Asphalt & Concrete Miller can be used for multiple tasks rather than being dedicated to a single use.

Figure 4:
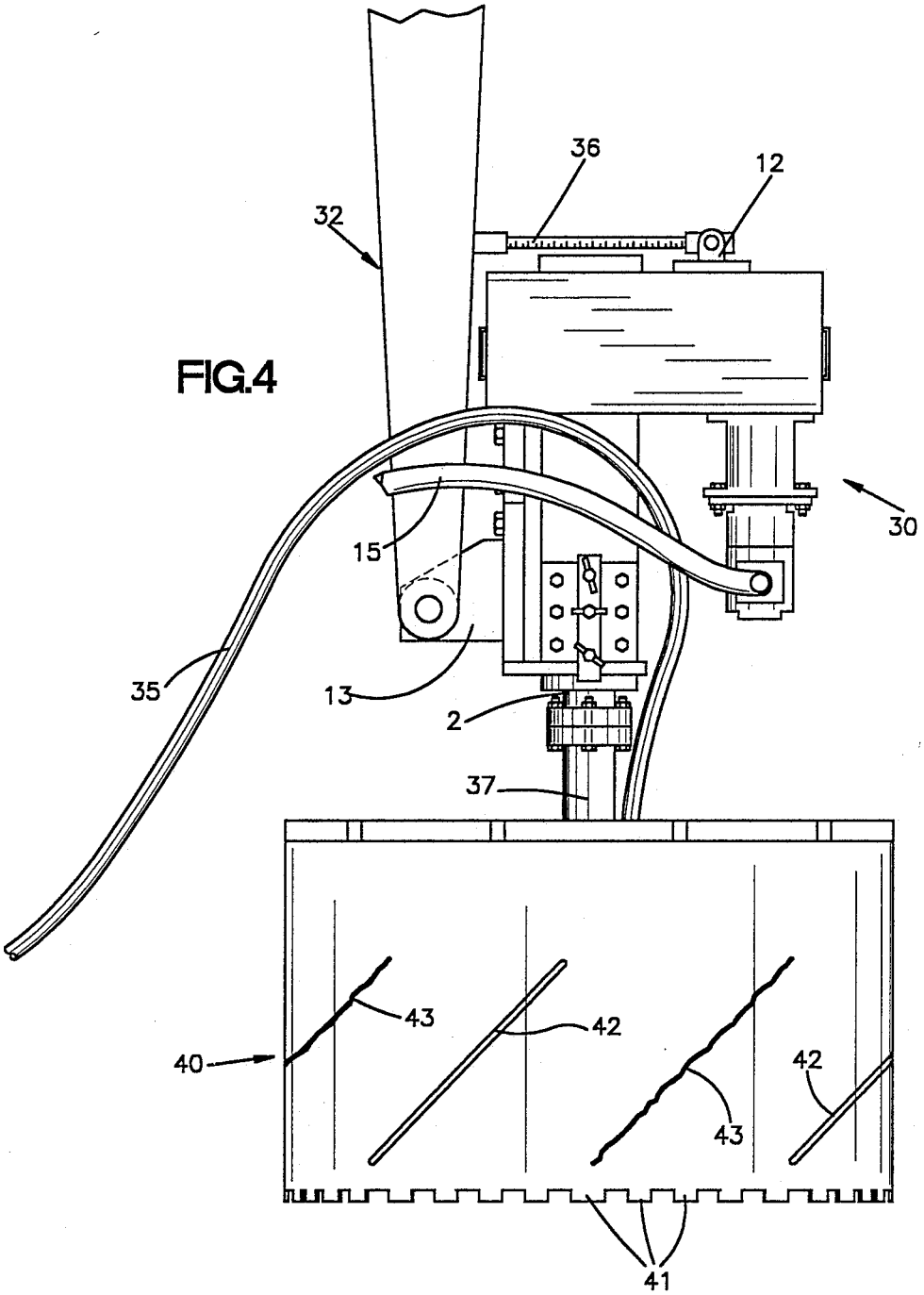
FIG. 4 is a side elevation of a second embodiment of the Vertical Asphalt & Concrete Miller showing a coring bit in place of the asphalt removal cutting head.
Figure 5:
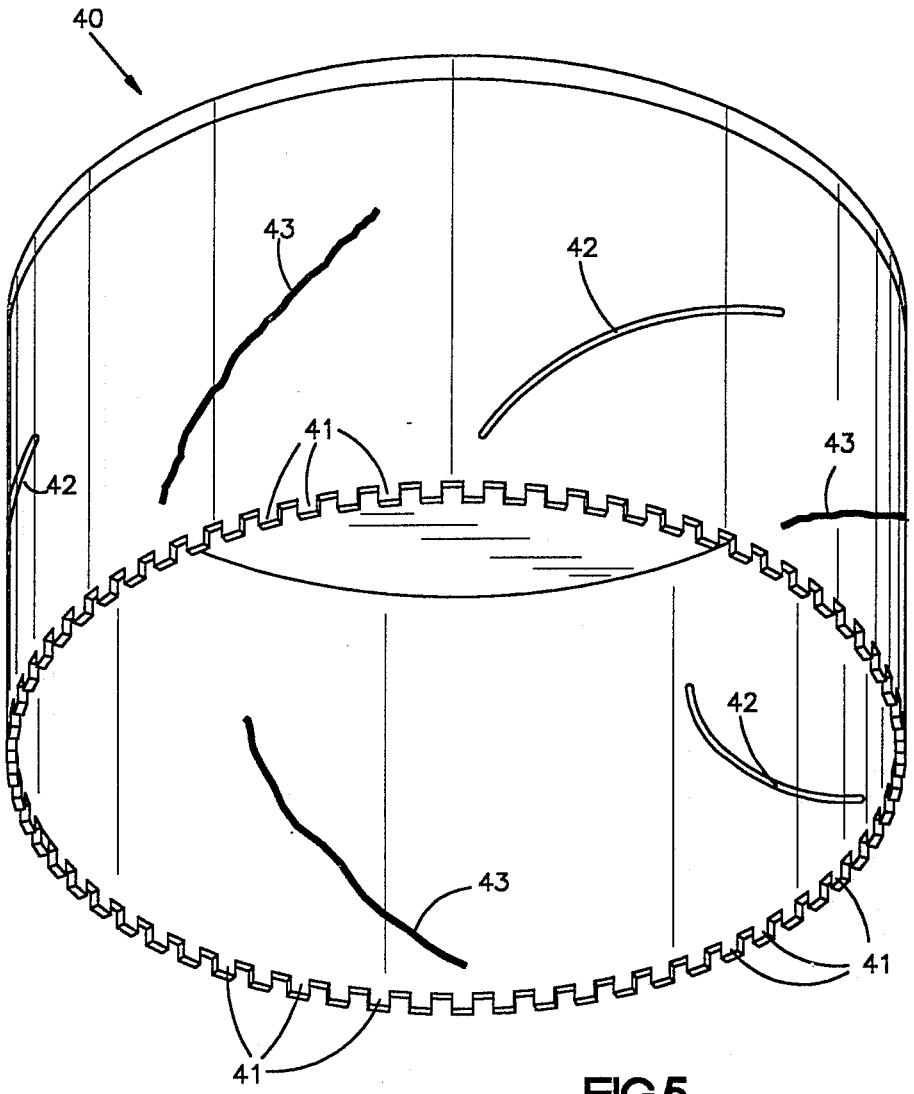
FIG. 5 is a perspective view of the manhole casting coring bit shown in FIG. 4.

A second embodiment of the present invention is shown in FIGS. 4 and 5. This embodiment is used for cutting the concrete or asphalt around manhole castings, water valves and monuments boxes embedded in roadways.

The coring bit 40 is attached to the Vertical Asphalt & Concrete Miller 30 in place of the cutting head 1. The coring bit 40 shown in FIGS. 4 and 5 is 48 inches in diameter and is used for cutting around manhole castings. Smaller diameter coring bits are used for cutting around water valves and monuments boxes. The coring bit 40 can be used in both concrete and asphalt.

The coring bit 40 is a hollow cylinder open at its lower end. A plurality of diamond toothed cutting bits 41 are placed on the lower edge of the coring bit 40. The diamond toothed cutting bits 41 are 0.75 inches long and 0.275 inches wide. The diamond toothed cutting bits 41 are slightly wider than the wall thickness of the coring bit 40. The gap between the diamond toothed cutting bits 41 is 1.5 inches. The coring bit 40 cuts a narrow, approximately 0.3 inches, cylindrical ring around the manhole casting. A shaft 37 at the top of the coring bit 40 connects the coring bit 40 to the drive shaft 2 on the Vertical Asphalt & Concrete Miller 30. The cutting bits 41 can be placed on the side wall of the coring bit 40 on one or both surfaces. This configuration will result in cut larger than 0.3 inches.

Three angled grooves 42, ⅛ inch deep, are equally spaced around the outside and inside surfaces of the coring bit 40. These grooves 42 help in ejecting debris from around the coring bit 40. The angle of these groves is about 38.5 degrees. The Vertical Asphalt & Concrete Miller 30 rotates clockwise when being used with the coring bit 40.

Three angled projections 43 are also equally spaced around the outside and the inside of the coring bit 40. An ⅛ inch carbide weld bead can be used for these projections 43. The angled projections 43 protect the surfaces of the coring bit 40 from wear against the concrete or asphalt when a manhole casting is being cut out. The angle of these projections 43 is about 38.5 degrees.

A water spray is used to flush debris out of the cut. Water is supplied through a hose 35 to a swivel connection (not shown) on a mounting flange (also not shown) at the lower end of the coring bit shaft 37. Internal passages within the mounting flange direct a water spray against the inner side of the coring bit 40.

The Vertical Asphalt & Concrete Miller 30 when used with the coring bit 40 is not attached to the boom of the back hoe as shown in FIG. 1A. The back hoe is fitted with an extender 32. The extender 32 functions to move the Vertical Asphalt & Concrete Miller 30 vertically up and down in the same fashion a drill press moves the drill bit up and down. The boom on a back hoe would normally provide up and down motion to any tool fixed to its end by extending or retracting its boom. This changes the angle of the tool relative to the road surface. A 48 inch diameter coring bit would move through an arc of 1½ to 2 inches when cutting through 8 to 12 inches of concrete if the Vertical Asphalt & Concrete Miller 30 were attached as shown in FIG. 1A. This arc would bind the coring bit 40 and either stall the Vertical Asphalt & Concrete Miller 30 or cause extreme wear on the coring bit 40.

The extender 32 is a common accessory for back hoes. The accessory known as "Extradig" manufactured by JCB or "Extend-A-Hoe" manufactured by John Deere can be used.

An additional adjustable adapter 36 is used to attach the Vertical Asphalt & Concrete Miller 30 to the extender 32. This adjustable adapter 36 attaches between the extender 32 and the upper adapter plate 12. The adjustable adapter 36 consists of two brackets and a threaded rod with nuts attached to both ends. The brackets are connected by pins to the extender 32 and the upper adapter plate 12. After the Vertical Asphalt & Concrete Miller 30 has been attached to the extender 32, the nuts on the adjustable adapter 36 are adjusted until the Vertical Asphalt & Concrete Miller 30 and the coring bit 40 are parallel to the vertical axis of the extender 32.

Two modifications can be made to the stock extender 32. These modifications provide for better control of the vertical force applied to the coring bit 40. Normally the back hoe is equipped with a foot operated hydraulic control valve for the vertical movement of the extender 32. The control provided by the foot valve can be coarse. A needle valve (not shown) can be connected to the extender hydraulic lines in parallel with the foot control valve. The needle valve allows finer control over the vertical movement of the extender 32.

Since the cutting teeth 41 are out of sight, it is difficult for the equipment operator to judge the cutting rate. Because the coring bit 40 is very noisy, the operator can not use the noise level to judge the cutting rate. To help the operator in achieving the maximum cutting rate, a pressure gauge (not shown) can be attached to the hydraulic supply 15 to the Vertical Concrete and Asphalt Miller 30. It has been determined in actual field use of the coring bit 40 that maintaining a pressure of 2000 psi will achieve an optimum cutting rate of 1½ inches per minute in concrete for a 48 inch coring bit 40. When using a 22 inch coring bit 40, the pressure should maintained at 1500 psi. The operator adjusts the needle valve to maintain either 2000 psi for the 48 inch diameter coring bit 40 or 1500 psi for the 22 inch diameter coring bit 40.

What is claimed is:

1. In combination with various construction equipment, a machine for removing castings comprising:

(a) a first mounting means for removeably attaching said machine to said construction equipment;

(b) a drive shaft having its axis in a vertical position;

(c) a drive means for rotating said drive shaft; and (d) a hollow cylindrical cutting tool, said cutting tool being attached to said drive shaft and being provided with a plurality of cutting teeth means located on the bottom edge of the cylindrical portion of said cutting tool, said cutting tool having a plurality of spaced slanted grooves in the outer surface of said cylindrical portion, whereby said grooves eject debris and said cutting tool having a plurality of spaced slanted projections extending outward from the outer surface of said cylindrical portion, whereby said projections protect the surface of said cylindrical cutting tool from wear.

2. A machine as in claim 1 wherein said cylindrical cutting tool is provided with a plurality of spaced slanted grooves in the inner surface of said cylindrical portion, whereby said grooves eject debris.

3. A machine as in claim 1 wherein said cylindrical cutting tool is provided with a plurality of spaced slanted projections extending outward from the inner surface of said cylindrical portion, whereby said projections protect the surface of said cylindrical cutting tool from wear.

4. A machine as in claim 1 wherein said slanted projections and said slanted grooves are in alternate spaced relationship on the outer surface of said cylindrical portion.

5. A machine as in claim 1 wherein said cylindrical cutting tool is provided with a plurality of spaced slanted projections extending outward from the inner surface of said cylindrical portion, whereby said projections protect the surface of said cylindrical cutting tool from wear and said cylindrical cutting tool is provided with a plurality of spaced slanted grooves in the inner surface of said cylindrical portion, whereby said grooves eject debris, said slanted projections and said slanted grooves being in alternate spaced relationship.

6. A machine as in claim 1 wherein said cutting teeth means are diamond tipped cutting bits.

7. A machine as in claim 1 wherein said cutting teeth means are located on the inner and outer surfaces of said cylindrical portion.

8. In combination with various construction equipment, a machine for removing castings comprising:

(a) a first mounting means for removeably attaching said machine to said construction equipment;

(b) a drive shaft having its axis in a vertical position;

(c) a drive means for rotating said drive shaft;

(d) a hollow cylindrical cutting tool, said cutting tool being attached to said drive shaft and being provided with a plurality of cutting teeth means located on the bottom edge of the cylindrical portion of said cutting tool, said cutting tool having a plurality of spaced slanted grooves in the outer surface of said cylindrical portion, whereby said grooves eject debris and said cutting tool having a plurality of spaced slanted projections extending outward from the outer surface of said cylindrical portion, whereby said projections protect the surface of said cylindrical cutting tool from wear; and (e) means for raising and lowering said cylindrical cutting tool vertically.

9. A machine as in claim 8 wherein said cylindrical cutting tool is provided with a plurality of spaced slanted grooves in the inner surface of said cylindrical portion, whereby said grooves eject debris.

10. A machine as in claim 8 wherein said cylindrical cutting tool is provided with a plurality of spaced slanted projections extending outward from the inner surface of said cylindrical portion, whereby said projections protect the surface of said cylindrical cutting tool from wear.

11. A machine as in claim 8 wherein said slanted projections and said slanted grooves are in alternate spaced relationship on the outer surface of said cylindrical surface.

12. A machine as in claim 8 wherein said cylindrical cutting tool is provided with a plurality of spaced slanted projections extending outward from the inner surface of said cylindrical portion, whereby said projections protect the surface of said cylindrical cutting tool from wear and said cylindrical cutting tool is provided with a plurality of spaced slanted grooves in the inner surface of said cylindrical portion, whereby said grooves eject debris, said slanted projections and said slanted grooves being in alternate spaced relationship.

13. A machine as in claim 8 wherein said cutting teeth means are diamond tipped cutting bits.

14. A machine as in claim 8 wherein said cutting teeth means are located on the inner and outer surfaces of said cylindrical portion.

15. A machine as in claim 8 wherein said first mounting means having a means for adjusting said machine to maintain said drive shaft axis in parallel relationship to said raising and lowering means.

16. A coring bit comprising a hollow cylindrical cutting tool, said cutting tool being provided with a plurality of cutting teeth means located on the bottom edge of the cylindrical portion of said cutting tool, said cutting tool having a plurality of spaced slanted grooves in the outer surface of said cylindrical portion, whereby said grooves eject debris and said cutting tool having a plurality of spaced slanted projections extending outward from the outer surface of said cylindrical portion, whereby said projections protect the surface of said cylindrical cutting tool from wear.

17. A coring bit as in claim 16 wherein said cylindrical cutting tool is provided with a plurality of spaced slanted grooves in the inner surface of said cylindrical portion, whereby said grooves eject debris.

18. A coring bit as in claim 16 wherein said cylindrical cutting tool is provided with a plurality of spaced slanted projections extending outward from the inner surface of said cylindrical portion, whereby said projections protect the surface of said cylindrical cutting tool from wear.

19. A coring bit as in claim 16 wherein said slanted projections and said slanted grooves are in alternate spaced relationship on the outer surface of said cylindrical portion.

20. A coring bit as in claim 16 wherein said cylindrical cutting tool is provided with a plurality of spaced slanted projections extending outward from the inner surface of said cylindrical portion, whereby said projections protect the surface of said cylindrical cutting tool from wear and said cylindrical cutting tool is provided with a plurality of spaced slanted grooves in inner surface of said cylindrical portion, whereby said grooves eject debris, said slanted projections and said slanted grooves being in alternate spaced relationship.

21. A coring bit as in claim 16 wherein said cutting teeth means are diamond tipped cutting bits.

22. A coring bit as in claim 16 wherein said cutting teeth means are located on the inner and outer surfaces of said cylindrical portion.

* * * * *

UNITED STATES PATENT AND TRADEMARK OFFICE

CERTIFICATE OF CORRECTION

PATENT NO. : 4,968,101

DATED : Nov. 6, 1990

INVENTOR(S) : Emory R. Bossow

It is certified that error appears in the above—identified patent and that said Letters Patent is hereby corrected as shown below:

On the title page, item [76]:

Add Brian J. Nolan, 11020 Burlington Ridge, Chardon, Ohio 44024 as co-inventor

Signed and Sealed this

Seventeenth Day of March, 1992

*Attest:*

HARRY F. MANBECK, JR.

*Attesting Officer*

*Commissioner of Patents and Trademarks*